United States Patent [19]

Hinz et al.

[11] 4,334,449

[45] Jun. 15, 1982

[54] APPARATUS FOR SEVERING PAPER WEBS OR THE LIKE

[75] Inventors: Werner Hinz, Hamburg; Nikolaus Häusler, Oststeinbek, both of Fed. Rep. of Germany

[73] Assignee: Hauni-Werke Körber & Co. K.G., Hamburg, Fed. Rep. of Germany

[21] Appl. No.: 207,962

[22] Filed: Nov. 18, 1980

[30] Foreign Application Priority Data

Nov. 24, 1979 [DE] Fed. Rep. of Germany ..... 2947438

[51] Int. Cl.[3] ..... A24C 5/58

[52] U.S. Cl. ..... 83/342; 83/345

[58] Field of Search ..... 83/345, 342, 341

[56] References Cited

FOREIGN PATENT DOCUMENTS 619292 9/1936 Fed. Rep. of Germany .

1024090 3/1966 United Kingdom .

*Primary Examiner*—James M. Meister

*Attorney, Agent, or Firm*—Kontler, Grimes & Battersby

[57] ABSTRACT

An apparatus which subdivides an adhesive-coated web of paper or imitation cork into a succession of uniting bands which are draped around groups of coaxial cigarettes and filter plugs to form filter cigarettes has two drums rotating in opposite directions about parallel axes. One of the drums is a suction drum and serves to advance the leader of the web toward the nip of the two drums where the leader is severed to yield successive uniting bands. The suction drum has a number of equidistant axially parallel peripheral grooves each disposed in front of a cutting edge. The other drum carries detachable knives with cutting edges extending beyond the periphery of the other drum so that they can penetrate into the oncoming grooves during travel past the nip. The drums are rotated by mating gears and the radius of the cylinder which is formed by the cutting edges of the knives exceeds the radius of the pitch circle of the gear which drives the other drum. The cutting edges of the suction drum form a cylinder with a radius which is equal to or somewhat smaller than the radius of the pitch circle of the gear serving to drive the suction drum. The cutting edges of the knives define epicycloidal paths during travel toward, during penetration into and during withdrawal from the corresponding grooves. Those portions of the paths which are disposed in the respective grooves resemble loops with zeniths located in the interior of the grooves or at the entrances to such grooves. This ensures that expansion or contraction of the drums cannot result in clashing of the cooperating cutting edges.

17 Claims, 4 Drawing Figures

APPARATUS FOR SEVERING PAPER WEBS OR THE LIKE

BACKGROUND OF THE INVENTION

The present invention relates to apparatus for severing webs of paper or the like, especially for subdividing adhesive-coated webs of cigarette paper, imitation cork or like strip-shaped wrapping material into discrete uniting bands which can be used for connecting plain cigarettes with filter plugs to make filter cigarettes of unit length of multiple unit length.

Filter cigarettes are produced in so-called filter tipping machines, e.g., in machines of the type known as MAX S and manufactured by the assignee of the present application. Reference may be had to commonly owned U.S. Pat. No. 4,177,670 granted Dec. 11, 1979 to Heitmann et al. which discloses a machine wherein a filter plug of double unit length is placed between two coaxial plain cigarettes of unit length. The filter plug and the adjacent end portions of the plain cigarettes are thereupon draped into an adhesive-coated uniting band which is thereby converted into a tube constituting a means for sealingly connecting the filter plug with both plain cigarettes. The resulting filter cigarette of double unit length is thereupon severed midway across the filter plug and the tube to yield two filter cigarettes of unit length.

A conventional apparatus for subdividing continuous webs of adhesive-coated cigarette paper or like strip-shaped material into discrete uniting bands which are ready to connect filter plugs to plain cigarettes of unit length is disclosed in German Pat. No. 619,292. This patent discloses means for severing the web by resorting to a punching or stamping action. Such apparatus failed to gain widespread acceptance in the tobacco processing industry.

Another conventional apparatus which can be used for the making of adhesive-coating uniting bands is disclosed in British Pat. No. 1,024,090. Apparatus similar to or identical with that which is disclosed in this British patent have found widespread acceptance by the makers of filter cigarettes or analogous articles (the term filter cigarettes is intended to embrace filter tipped cigarillos and cigars). The apparatus of the British patent employs two rotary drums one of which has cutting edges serving to sever an adhesive-coated web at regular intervals so that the latter yields a succession of discrete uniting bands. The other drum is a suction drum which attracts the web and causes the latter to advance toward the severing station. Furthermore, the suction drum serves to transport freshly formed uniting bands away from the severing station as well as to constitute a hard base or anvil for the cutting edges of the one drum. The two drums rotate about parallel axes and the one drum supports a plurality of equidistant knives whose cutting edges strike against the hard peripheral surface of the suction drum in the course of a severing action, i.e., during separation of a uniting band from the leader of the running adhesive-coated web which normally consists of cigarette paper or imitation cork. A drawback of the just described severing apparatus is that the wear upon the peripheral surface of the suction drum as well as on the cutting edges of knives which are mounted on the one drum is very pronounced. This is due to the fact that the cutting edges of the knives strike against the peripheral surface of the suction drum in the course of each severing operation with attendant generation of noise and dulling of the cutting edges of the knives. Moreover, the severing operation is not always satisfactory because it does not involve the making of a cut of the type made by shears but rather a squeezing or pinching action which is performed by the cutting edge of a knife while the latter advances toward the exposed side of the web and penetrates therethrough on its way toward direct contact with the hard peripheral surface of the suction drum.

Another serious drawback of the just described apparatus is that the making of discrete uniting bands is accompanied by the generation of pronounced noise. The knives of the one drum act not unlike hammers by striking against the hard peripheral surface of the suction drum to sever the web transversely of the direction of its forward movement as a result of attraction of the leading edge of the web to the peripheral surface of the suction drum. Since the speed of filter tipping machines is on the increase from year to year to cope with the ever-increasing output of modern cigarette and filter rod making machinery, the noise which is generated by the severing apparatus for adhesive-coated webs is augmented by noise which is generated by other rapidly driven components of one or more machines in a production line so that the noise level is often sufficient to seriously affect the comfort and/or health of the attendants. It has been found that the just described apparatus fails to meet stringent provisions of authorities in many industrialized countries which establish standards for permissible noise levels in manufacturing plants and like establishments.

Attempts to reduce the noise of apparatus which form adhesive-coated uniting bands for use in filter tipping or like machines include resort to conventional severing rather than stamping or pinching techniques, i.e., to have two cooperating cutting edges which move past each other not unlike the blades of shears and to thereby make a cut starting at one marginal portion and progressing toward the other marginal portion of the running web. In other words, instead of relying on one set of knives whose cutting edges strike against a hard countersurface of anvil on penetration through a web of uniting band material, the modified apparatus employ two sets of knives or cutters whose cutting edges slide past one another in the course of a severing operation so that one avoids direct impact of cutting edges against an anvil. Such modified apparatus can furnish a satisfactory severing action at a given temperature of their components. However, due to certain peculiarities of construction and mode of operation of presently used high-speed filter tipping machines (including the aforementioned machines of the type known as MAX S), the temperature of component parts of the severing apparatus is influenced by several variable parameters. Thus, the MAX S machine employs a host of closely adjacent drum-shaped conveyors which transport plain cigarettes, filter plugs and filter cigarettes sideways, i.e., at right angles to the axes of such articles. A heating drum which effects rapid drying of adhesive paste at one side of each uniting band is placed in close proximity to the severing apparatus to ensure that a convoluted uniting band does not open up again, i.e., that it remains in sealing contact with the peripheral surface of the corresponding filter plug and the adjacent end portions of the associated plain cigarettes. Heat which is radiated by the aforementioned heating drum is absorbed in part by the rotary drum or drums of the severing apparatus. In fact, certain filter tipping machines employ severing apparatus with a heated drum in order to activate hot-melt or an analogous heat-activatable adhesive which is applied to one side of the web prior to subdivision into uniting bands. This is often necessary if the station where the freshly formed uniting bands are convoluted around filter plugs and portions of plain cigarettes is closely or immediately adjacent to the severing station. As the drum or drums of the severing apparatus undergo a heating action, their knives expand radially outwardly and are likely to strike against, rather than to bypass, each other. This can result in extensive wear upon and/or in rapid or immediate destruction of the severing apparatus with attendant losses in output.

OBJECTS AND SUMMARY OF THE INVENTION

An object of the invention is to provide a novel and improved apparatus for severing an adhesive-coated web of cigarette paper or the like and to construct and assemble the apparatus in such a way that any heating or cooling of its component parts does not adversely influence the severing operation.

Another object of the invention is to provide a novel and improved severing apparatus wherein the cooperating cutting edges which sever a running web of cigarette paper or the like at regular intervals to form a succession of uniting bands are disposed in such a way that they cannot strike against each other when the temperature of the surrounding atmosphere and/or of the carriers for such cutting edges rises or drops, even if the temperature changes are quite pronounced and take place within short intervals of time.

A further object of the invention is to provide a severing apparatus whose cutting action, within a wide temperature range, is more satisfactory than that of heretofore known severing apparatus.

An additional object of the invention is to provide a severing apparatus which can be utilized in existing filter tipping or like machines as a superior substitute for heretofore known apparatus for conversion of a running adhesive-coated web of paper or the like into a succession of discrete uniting bands.

Another object of the invention is to provide a severing apparatus which can include one or more heated components and/or which can be placed close to one or more heated components of a filter tipping or like machine without affecting the quality of its cutting action.

A further object of the invention is to provide a severing apparatus which generates less noise than heretofore known apparatus and wherein the useful life of knives or analogous parts is much longer than in conventional apparatus for the conversion of running webs into adhesive-coated uniting bands.

Another object of the invention is to provide novel and improved rotary carriers of cutting edges for use in an apparatus of the above outlined character.

The invention is embodied in an apparatus for subdividing a running web into discrete sections, particularly for transverse severing of an adhesive-coated web which is to yield a succession of sections constituting uniting bands for draping around groups of coaxial rod-shaped articles (such as pairs of plain cigarettes of unit length with a filter plug of double unit length therebetween). The apparatus comprises first and second carriers (e.g., drums) which are rotatable about parallel axes and respectively have a plurality of first and second elongated cutting edges disposed in substantial parallelism with the respective axes. Each first cutting edge cooperates with a second cutting edge during rotation of the carriers to sever a web which is fed between the carriers. The first carrier is formed with axially parallel recesses or grooves which are adjacent to the respective first cutting edges (the grooves are preferably located immediately in front of the corresponding first cutting edges, as considered in the direction of rotation of the first carrier). Successive second cutting edges penetrate into the oncoming grooves during rotation of the two carriers relative to each other. The apparatus further comprises means for rotating the carriers in opposite directions including mating first and second gears which are respectively coaxial with the first and second carriers. The first cutting edges are disposed at the periphery of a cylinder having a radius which at least approximates the radius of the pitch circle of the first gear, and the second cutting edges are disposed at the periphery of a second cylinder whose radius exceeds the radius of the pitch circle of the second gear. The carriers define a nip for the passage of the web therethrough and successive second cutting edges penetrates into the oncoming grooves of the first carrier in the region of such nip. One of the carriers (preferably the first carrier) has means for advancing the web lengthwise toward and into the nip and for transporting freshly formed sections away from the nip. The advancing and transporting means preferably includes suction ports provided in the first carrier so as to attract the leader of the web during travel of such leader toward the nip of the two carriers and to transport successively formed sections during travel away from the nip.

The radius of the first cylinder may be identical with or slightly smaller than the radius of the pitch circle of the first gear. In the first instance, the epicycloidal path which is defined by each second cutting edge during travel toward, into and from a groove at the periphery of the first carrier has an elongated loop-shaped portion whose zenith is located in the interior of the groove. If the radius of the first cylinder is smaller than the radius of the pitch circle of the first gear, the zenith of the looped portion of the epicycloidal path is located at the locus where the first and second cutting edges overlap in the course of a severing operation.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
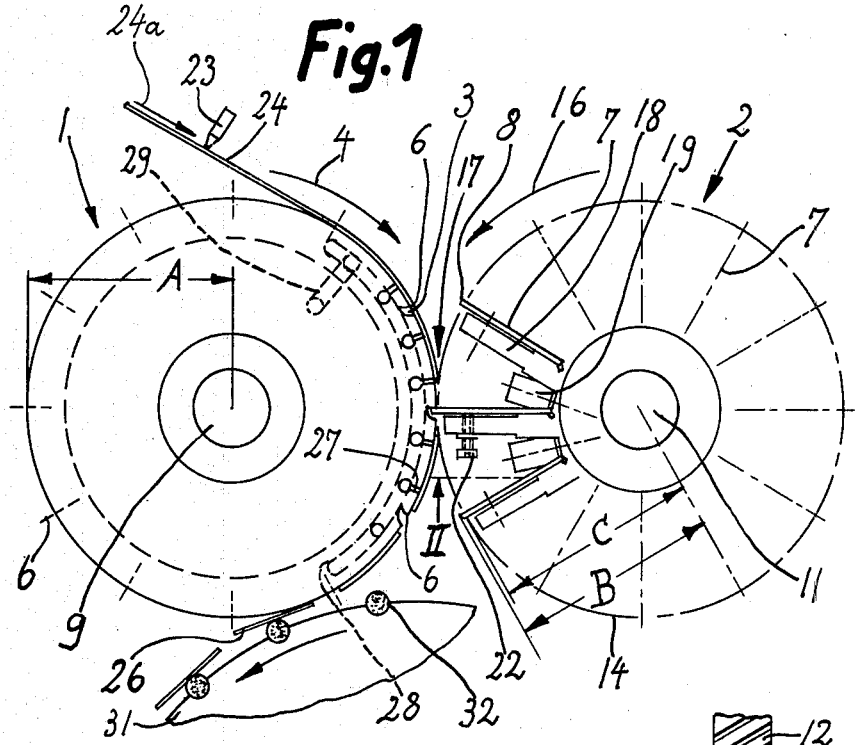
FIG. 1 is a schematic side elevational view of a severing apparatus which embodies one form of the invention and serves to subdivide a running adhesive-coated web of cigarette paper or the like into a file of discrete sections which constitute uniting bands.
Figure 2:
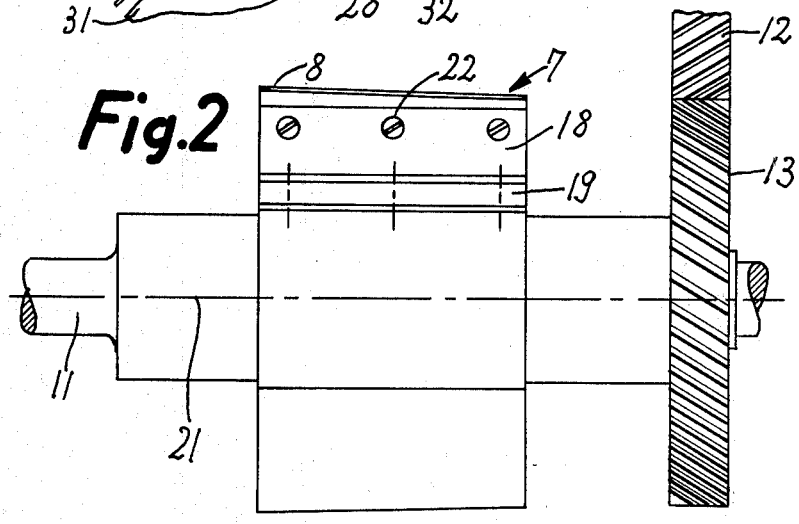
FIG. 2 is a fragmentary plan view as seen in the direction of arrow II in FIG. 1.

The severing apparatus which is shown in FIGS. 1 and 2 comprises two rotary drum-shaped carriers 1 and 2 which are mounted on parallel horizontal shafts 9 and 11. The carrier 1 constitutes a suction drum so that it can advance a continuous web 24 of cigarette paper or the like toward the cutting or severing station 17 at the nip of the carriers 1, 2 as well as to transport freshly formed web sections or uniting bands 26 away from the station 17. The cylindrical peripheral surface of the suction drum 1 is formed with equidistant narrow recesses or grooves 3 which are parallel to its axis and extend all the way between the two ends of the peripheral surface. The direction in which the shaft 9 drives the suction drum 1 is indicated by the arrow 4. The surfaces which bound the grooves 3 from behind, as considered in the direction indicated by the arrow 4, and the adjacent portions of the cylindrical peripheral surface of the suction drum 1 form a series of cutting edges 6 each of which is disposed immediately behind the respective groove 3 (as considered in the direction of arrow 4). The cutting edges 6 are disposed at the periphery of an imaginary cylinder which coincides with the peripheral surface of the suction drum 1 and has a radius A.

The carrier 2 supports a plurality of equidistant knives 7, one for each groove 3 of the suction drum 1, and the cutting edges 8 of the knives 7 extend beyond the peripheral surface of the carrier 2. The radius of the imaginary cylinder which is formed by the cutting edges 8 of the knives 7 is indicated at B.

The means for rotating the suction drum 1 and the carrier 2 at the same peripheral speed comprises two mating gears 12 and 13 which are respectively secured to the shafts 9 and 11. The gear 12 or 13 is driven by the prime mover of the filter tipping machine which embodies the apparatus of FIGS. 1 and 2. Such prime mover is shown at PM in FIG. 1 of the aforementioned U.S. Pat. No. 4,177,670 to Heitmann et al., and the suction drum 1 and carrier 2 of the improved severing apparatus respectively replace the suction drum 19 and knife carrier 21 shown in FIG. 1 of the patent to Heitmann et al. The transmission ratio of gears 12 and 13 is one-to-one, i.e., the points on their pitch circles orbit at identical speeds when the gear 12 or 13 receives torque from the prime mover of the filter tipping machine.

The radius of the pitch circle of the gear 12 on the shaft 9 for the suction drum 1 equals A, i.e., it is the same as the radius of the imaginary cylinder formed by the cutting edges 6 behind the respective grooves or recesses 3 of the suction drum. The pitch circle 14 (indicated in FIG. 1 by a phantom line) of the gear 13 which drives the shaft 11 has a radius C which is smaller than the radius B of the imaginary cylinder formed by the cutting edges 8 of the knives 7. This ensures that, when the gears 12 and 13 rotate, successive knives 7 cause their cutting edges 8 to enter the oncoming grooves 3 of the suction drum 1 whereby the cutting edge 8 which is about to enter and which thereupon enters the oncoming groove 3 cooperates with the respective cutting edge 6 to sever the web 24 at right angles to the direction (arrow 24*a*) of lengthwise movement of the web under the action of the suction drum 1. The arrow 16 denotes the direction of rotation of the carrier 2, i.e., the suction drum 1 and the carrier 2 rotate in the opposite directions. Each cutting edge 8 which approaches the station 17 is located slightly ahead of the corresponding (associated) cutting edge 6 to thus ensure that the respective knife 7 can penetrate into the oncoming groove 3 of the suction drum 1.

The dimensions of the knives 7 on the carrier 2 are preferably selected in such a way that the radius B exceeds the radius C by approximately 0.5 percent. Each knife 7 is mounted on a knife holder 18 which is secured to the carrier 2 by wedge 19. The mounting of knives 7 in the respective holders 18 and the mounting of holders 18 in the carrier 2 is such that the planes of the cutting edges 8 are slightly inclined with reference to the axis 21 of the shaft 11, i.e., with reference to the common axis of the carrier 2 and gear 13 (see FIG. 2). This ensures that the cutting edges 6 and the cooperating cutting edges 8 perform a genuine shearing action, i.e., such action begins at one marginal zone of the web 24 and progresses toward the other marginal zone.

The apparatus further comprises means for adjusting the positions of portions of cutting edges 8 relative to the associated cutting edges 6 (as considered in the circumferential direction of the carrier 2) so that each cutting edge 8 properly engages the respective cutting edge 6 along the full length thereof. The adjusting means comprises a set or row of screws 22 which extend lengthwise of each cutting edge 8 and can be regulated to impart to the cutting edge 8 a substantially spiral configuration. FIG. 2 shows a row of three adjusting screws 22 for a cutting edge 8; however, the number of such screws can be greatly increased if one desires to change the orientation of relatively small portions of each edge 8 so as to even more reliably ensure continuous contact between the cutting edges 6 and 8 in the course of a severing operation. Such elevation of (spiral or substantially spiral) configuration of the cutting edges 8, coupled with slight inclination of cutting edges 8 relative to the axis 21 of the shaft 11, ensures that the cooperating cutting edges 6 and 8 make clean cuts across the running web 24, starting at one marginal portion and progressing gradually toward the other marginal portion of the web. In other words, the cutting edges 6, 8 of each pair perform a severing action which is clearly analogous to that of the blades of shears.

As mentioned above, the suction drums 1 serves as a means for advancing the leader of the web 24 toward the severing or cutting station 17 as well as for transporting freshly formed uniting bands 26 away from the station 17. To this end, the peripheral surface of the suction drum 1 is formed with suction ports 27 which are disposed between neighboring grooves 3 and attract the non-coated side of the web 24. The inner end portions of the ports 27 are connected with a groove 28 which extends along an arc of predetermined length to ensure that a blower, fan or an analogous suction generating device (not specifically shown) is in communication with those ports 27 which are adjacent to the uncoated side of the web 24 as well as to those uniting bands 26 which are transported from the station 17 to a transfer station between the suction drum 1 and a rotary drum-shaped conveyor 31 serving to transport groups 32 of coaxial rod-shaped articles toward a wrapping or rolling station. Each group 32 includes two spaced-apart coaxial plain cigarettes and a filter plug of double unit length between the plain cigarettes. The suction drum 1 applies the uniting bands 26 in such a way that the bands are substantially tangential to the respective groups 32 and that each band adheres to the corresponding filter plug along the full length of such plug as well as to the adjacent end portions of the corresponding plain cigarettes of unit length. The drum 31 of FIG. 1 performs the same function as the drums 12 in FIG. 1 of the aforementioned U.S. Pat. No. 4,177,670 to Heitmann et al. The groove 28 communicates at times with a channel 29 which is in communications with the intake of the aforementioned suction generating device.

The peripheral speed of the suction drum 1 preferably exceeds the speed of lengthwise movement of the web 24 in the direction of the arrow 24*a*. This ensures that the suction drum 1 slips relative to the leader of the web 24 and that the freshly formed uniting bands 26 are automatically separated from each other by gaps of requisite length (this is shown in the lower left-hand portion of FIG. 1) so as to ensure that a next-following uniting band 26 cannot interfere with attachment of the preceding band 26 to the respective groups 32 of coaxial rod-shaped articles. The reference character 23 denotes the nozzle of a paster which serves to coat one side of the web 24 with a suitable adhesive, e.g., a hotmelt.

Figure 3:
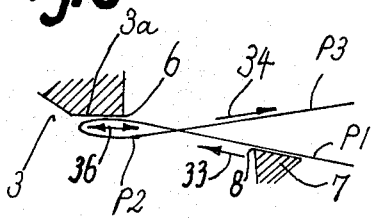
FIG. 3 is a diagrammatic view of the path of movement of the cutting edge of a knife relative to the associated cutting edge on the first carrier in the course of a severing operation.

FIG. 3 illustrates the path of movement of the cutting edge 8 of a knife 7 relative to the corresponding cutting edge 6 while the suction drum 1 and the carrier 2 respectively rotate in the directions indicated by the arrows 4 and 16 and the cutting edges 6, 8 approach and move past and beyond the severing station 17. The path along which the cutting edge 8 of FIG. 3 moves is a substantially cycloidal path. The arrow 33 denotes the direction of approach of the cutting edge 8 toward the cutting edge 6 while the two cutting edges advance toward the station 17. The first portion P1 of the path is followed by a loop-shaped portion P2 which is substantially parallel to the surface bounding a portion of the corresponding groove 3 in immediate proximity to the cutting edge 6. The path portion P2 is formed by the cutting edge 8 in part during penetration into and in part during withdrawal from the corresponding groove 3. The cutting edges 6 and 8 overlap each other while the edge 8 travels along the path portion P2. Severing of the web 24 takes place while the cutting edge 8 travels along the path portion P2, i.e., while successive increments of the edge 8 (as considered in the axial direction of the suction drum 1, i.e., in the longitudinal direction of the respective groove 3) penetrate into that groove which is located in front of the illustrated cutting edge 6. The severing action is progressive due to the aforediscussed inclination of the cutting edge 8 relative to the axis 21 of the shaft 11. The cutting edge 8 moves in the direction of arrow 34 and along the path portion P3 shown in FIG. 3 during movement away from the cutting edge 6, i.e., subsequent to removal or retraction from the respective groove 3.

The double-headed arrow 36 indicates the directions of expansion and contraction of the knife 7 and suction drum 1 in response to heating and cooling. This arrow shows that the expansion or contraction is substantially parallel to the parts of looped portion P2 of the path of the cutting edge 8 so that the expansion or contraction of the suction drum 1 and/or knife 7 cannot entail a clashing of the cutting edges 6, 8 and/or other damage to the apparatus. In other words, the direction in which the cutting edge 6 and/or 8 moves in response to heating or cooling of the suction drum 1 and/or knife 7 is substantially or exactly parallel to the plane of the surface which flanks the groove 3 in immediate proximity to the cutting edge 6. This invariably and reliably prevents any interference between the cooperating cutting edges and ensures longer useful life of the parts 1 and 7 of the improved apparatus. Moreover, once the orientation of the cutting edge 8 relative to the associated cutting edge 6 is selected and adjusted by the corresponding set of screws 22, such orientation remains unchanged for extended periods of time because the cutting edge 6 cannot influence the orientation of the associated cutting edge 8 owing to the fact that the cutting edges are not likely to clash or are incapable of clashing.

Figure 4:
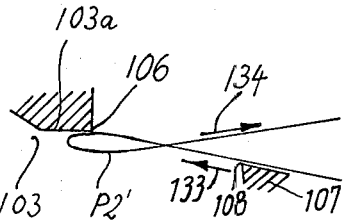
FIG. 4 is a similar diagrammatic view of the path of movement of the cutting edge of a knife in a slightly modified severing apparatus.

Referring to FIG. 4, there is shown the cutting edge 108 of a knife 107 and the cutting edge 106 of a suction drum in a somewhat modified apparatus. The difference between the apparatus which embodies the structure of FIG. 4 and the severing apparatus of FIG. 1 to 3 is that the radius of the peripheral surface of the suction drum which includes the cutting edge 106 of FIG. 4 is slightly smaller than the radius of the pitch circle of the gear which drives the suction wheel. The difference between the two radii is in the range of a small fraction of one millimeter, e.g., between one and two tenths of one millimeter. This means that the looped portion P2′ of the cycloidal path which is described by the cutting edge 108 during travel toward, past and beyond the severing station is shifted relative to the corresponding looped portion P2 of the path shown in FIG. 3. In other words, the zenith of the looped portion P2′ is located outside of or at the entrance to the gap 103 shown in FIG. 4. It will be noted that, while moving in the direction of the arrow 133, the cutting edge 108 starts to overlap the cutting edge 106 in the region of maximum width of the looped epicycloidal path portion P2′, i.e., in the region where the two cutting edges are nearest to each other. The arrow 134 denotes the direction of movement of the cutting edge 108 on its way away from the associated cutting edge 106.

An important advantage of the severing apparatus which embodies the structure of FIG. 4 is that the generation of noise is even less pronounced than in the apparatus of FIGS. 1 to 3.

Such reduction of noise can be accomplished without affecting the quality of the cut, i.e., the transverse cut across the running web is just as clean as in the apparatus of FIGS. 1 to 3.

As mentioned above, the difference between the radius of the imaginary cylinder which is formed by the cutting edges 106 (only one of which is shown in FIG. 4) and the radius of the pitch circle of the gear which drives the suction drum embodying the cutting edges 106 is very small (in the range of one or two tenths of one millimeter). On the other hand, the difference between the radii B and C shown in FIG. 1 and the corresponding radii of the apparatus embodying the structure of FIG. 4 is in the range of one or more millimeters. The aforementioned design wherein the cutting edges 106 and 108 begin to overlap when the cutting edge 108 reaches the zenith of its looped path portion P2′ has been found to be especially desirable and advantageous because it ensures the making of clean cuts as well as pronounced reduction of noise and elimination of the influence of temperature changes upon the quality of the severing operation and/or the useful life of the component parts of the apparatus.

All embodiments of the improved apparatus share the advantage that the parts of the looped portion P2 or P2′ of the path along which a cutting edge 8 or 108 advances toward, past and beyond the severing station are substantially parallel to the surface 3*a* or 103*a* (see FIGS. 3 and 4) so that the expansion or contraction of the suction drum and/or knives 7 or 107 cannot result in clashing of the cutting edges 6, 8 or 106, 108.

It is clear that the improved apparatus will operate properly if the transmission ratio of the gears which drive the two rotary carriers deviates from one-to-one, i.e., as long as the ratio is m:n wherein m and n are whole numbers and m:n is also a whole number. The ratio of one-to-one has been found to be desirable and advantageous because each and every knife 7 or 107 invariably penetrates into one and the same groove 3 or 103 whenever such knife moves past the severing station. This ensures that the adjustment of cutting edges 8 or 108 relative to the associated cutting edges 6 or 106 is even more likely to remain intact. The pitch circle diameters of the gears which drive the two rotary carriers are preferably identical, and these diameters are proportional to the number of cutting edges on each of the carriers.

In each of the illustrated embodiments of the improved apparatus, the severing action is abrupt in spite of the fact that it progresses in a direction from one marginal portion toward the other marginal portion of the web. Stressing of the bearings for the shafts which support the rotary carriers of the improved severing apparatus is reduced owing to the aforementioned inclination of cutting edges 8 or 108 relative to the axis of the respective shaft. This distributes the stresses in the longitudinal direction of the shafts during severing of the running web. Thus, the severing action is clearly analogous to the cutting action of the blades of shears rather than to that of many presently known severing apparatus wherein the protruding cutting edges strikes against the peripheral surface of the suction drum to thus instantly sever a web all the way between the two marginal portions of the web.

The extent to which the configuration of the cutting edges 8 or 108 departs from a straight line (under the influence of the screws 22 or analogous adjusting means) is relatively small, i.e., the spiral configuration is hardly noticeable. Nevertheless, such adjustment further contributes to a more satisfactory severing action because the distance between the cutting edges 8 or 108 on the one hand and the cooperating or associated cutting edges 6 or 106 on the other hand can be selected and regulated with an extremely high degree of precision.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for subdividing a running web into discrete sections, particularly for transverse severing of an adhesive-coated web which is to yield a succession of uniting bands for draping around groups of coaxial rod-shaped articles, comprising first and second carriers rotatable about parallel axes and respectively having a plurality of first and second elongated cutting edges disposed in substantial parallelism with the respective axes, each of said first cutting edges cooperating with a second cutting edge during rotation of said carriers to sever a web which is fed between said carriers, said first carrier further having axially parallel recesses adjacent to the respective first cutting edges and successive second cutting edges penetrating into the oncoming recesses during rotation of said carriers relative to each other; and means for rotating said carriers in opposite directions including mating first and second gears which are respectively coaxial with said first and second carriers, said first cutting edges being disposed at the periphery of a first cylinder having a radius which at least approximates the radius of the pitch circle of said first gear and said second cutting edges being disposed at the periphery of a second cylinder having a radius exceeding the radius of the pitch circle of said second gear.

2. The apparatus of claim 1, wherein said carriers define a nip for the passage of the web therethrough and successive second cutting edges penetrate into the oncoming recesses of said first carrier in the region of said nip, one of said carriers having means for advancing the web lengthwise toward said nip and for transporting successive sections away from said nip.

3. The apparatus of claim 2, wherein said one carrier is said first carrier, said means for advancing and transporting including suction ports provided in said first carrier and arranged to attract the leader of the web during travel of such leader toward said nip and to transport successively formed sections during travel away from said nip.

4. The apparatus of claim 1, wherein said first cutting edges are disposed behind the nearest recesses as considered in the direction of rotation of said first carrier.

5. The apparatus of claim 1, wherein the radius of said first cylinder is identical with the radius of the pitch circle of said first gear.

6. The apparatus of claim 1, wherein the radius of the pitch circle of said first gear slightly exceeds the radius of said first cylinder.

7. The apparatus of claim 6, wherein each second cutting edge which approaches, penetrates into and leaves an oncoming recess in the course of a severing operation advances along an epicycloidal path, said path having a zenith in that region thereof where the respective second cutting edge begins to overlie the associated first cutting edge while the second cutting edge penetrates into the oncoming recess of said first carrier.

8. The apparatus of claim 6, wherein the difference between the radius of the pitch circle of said first gear and the radius of said first cylinder is a fraction of one millimeter.

9. The apparatus of claim 1, wherein the difference between the radius of said second cylinder and the radius of the pitch circle of said second gear is at least one millimeter.

10. The apparatus of claim 1, wherein said gears have identical pitch diameters.

11. The apparatus of claim 10, wherein the diameters of said pitch circles are proportional to the numbers of the respective first and second cutting edges.

12. The apparatus of claim 10, wherein each of said carriers has a shaft and said gears are rigid with the respective shafts.

13. The apparatus of claim 1, wherein said second cutting edges are slightly inclined with reference to the axis of said second carrier so that successive increments of each second cutting edge overlap successive increments of the oncoming first cutting edge in the course of each severing operation.

14. The apparatus of claim 1, further comprising means for adjusting portions of said second cutting edges, as considered in the circumferential direction of said second carrier.

15. The apparatus of claim 14, wherein said adjusting means comprises a plurality of screws mounted on said second carrier and engaging selected portions of the respective second cutting edges, there being a set of several screws for each of said second cutting edge and the screws of each set forming a row extending lengthwise of the respective second cutting edge.

16. The apparatus of claim 1, further comprising a plurality of knives and holder means separably securing said knives to said second carrier, each of said knives having a cutting edge and the cutting edges of said knives constituting said second cutting edges.

17. The apparatus of claim 1, wherein each of said second cutting edges defines a substantially epicycloidal path during travel toward, into and from a recess of said first carrier.

* * * * *